US006050462A

United States Patent [19]

Petrou et al.

[11] Patent Number: 6,050,462

[45] Date of Patent: Apr. 18, 2000

[54] GARMENT HANGER WITH PINCH CLIPS

[76] Inventors: Nicoleon Petrou, Boulevard 1, Oriente #121, C.D. Ind. Mesa de Otay, Tijuana, B.C., Mexico; David Petrou, 2010 Wendover St., Apt. 1, Pittsburgh, Pa. 15217

[21] Appl. No.: 09/299,869

[22] Filed: Apr. 27, 1999

[51] Int. Cl.[7] ..... A47G 25/48

[52] U.S. Cl. ..... 223/96

[58] Field of Search ..... 223/90, 91, 93, 223/96, 95, 85

[56] References Cited

U.S. PATENT DOCUMENTS

| | | | |
|---|---|---|---|
| D. 190,843 | 7/1961 | Levine | 223/85 |
| 648,534 | 5/1900 | Seger | 223/96 |
| 3,744,685 | 7/1973 | Hart | 223/96 |
| 4,209,879 | 7/1980 | Paajanen | 24/248 R |
| 4,248,363 | 2/1981 | Zuckerman et al. | 232/91 |

*Primary Examiner*—Bibhu Mohanty

*Attorney, Agent, or Firm*—Levisohn, Lerner, Berger and Langsam

[57] ABSTRACT

A pinch clip for a garment hanger, and a garment hanger having such pinch clip, is disclosed. The clip includes an opposable retaining member spring biased into a closed position against a flange formed on one end of the main support of the hanger. The main support includes a through-hole, gap, or opening through which the proximal finger-grip end of the retaining member may pass when the pinch clip is opened. The distal end of the retaining member abuts the flange when it is in the closed position. When force is applied to the proximal end, the clip opens, and the proximal end nests inside and passes through the through-hole. In this way, the clip can be made substantially coplanar with the main support of the hanger, and a more streamlined hanger is the result. The invention may also be molded from a single mold, thereby simplifying the manufacturing process. A ridge is provided around one end of the retaining member for preventing clothing from getting caught between the proximal finger-grip portion of the retaining member and the main support of the hanger.

17 Claims, 5 Drawing Sheets

GARMENT HANGER WITH PINCH CLIPS

BACKGROUND OF THE INVENTION

1. Field of the Invention

The invention relates to garment hangers, and more specifically to garment hangers having pinch clips for the retention of garments.

2. Description of Related Art

Garment hangers are frequently employed to store and maintain clothing in closets, on display racks, and the like. Many articles of clothing can be supported on the basic hanger, which includes a hook portion and a somewhat arcuate main support portion. However, some garments are not easily supported on the basic conventional hanger. Pants or slacks, for example, need some additional support structure if they are to be hung on a hanger. One common solution to this problem is the provision of a straight cross-bar formed on the arcuate main support. Pants and the like may be draped over the cross-bar.

There are several drawbacks to the cross-bar approach to the problem. First, clothing draped over the cross-bar is likely to fall off as it is not securely disposed on the hanger. Additionally, the addition of a cross-bar to a hanger adds a significant amount of material to the hanger, thus making the hanger more expensive and more difficult to manufacture. Moreover, a hanger with a cross-bar is substantially heavier than one without; it is thus more difficult and more expensive to ship.

One solution to the cross-bar dilemma is the provision of pinch clips at the ends of the main support. Pinch clips are generally spring biased closed and provided with thumb or finger rests to facilitate opening. Clothing is inserted in between the open pinch clip and the main support. When the pinch clip is closed, clothing is retained between the clip and the main support owing to the spring bias force. In essence, conventional garment hanger pinch clips function similarly to clothes pins. An example of a prior pinch clip can be found in U.S. Pat. No. 5,178,306 to Petrou, the same inventor as that of the instant invention.

While a hanger having a conventional pinch clip does not suffer from the same drawbacks as the hanger having a cross-bar, the conventional garment hanger pinch clip is not perfect. The conventional pinch clip is bulky and adds significantly to the thickness or profile of the hanger. Consequently, the use of multiple hangers having pinch clips reduces the amount of clothing one can hang on a given rack or in a given closet. Pinch clips are usually two-pieces, i.e., the opposable retaining piece is typically molded separately from the rest of the hanger. This arrangement complicates the molding and manufacturing process. Further, the separate piece is usually attached to the main support by a clamping metal or plastic crimp that provides the spring biasing force to the clip. Should the crimp lose its elasticity, it can fall off, and the opposable retaining piece can easily fall off and become lost also.

Also, because conventional pinch clips are spring biased against the main support of the hanger, conventional pinch clips typically have a gap between the finger-grip portion of the retaining piece and the main hanger support. It is common for clothing to get caught or snagged in this gap, possibly resulting in the tearing of the clothing.

SUMMARY OF THE INVENTION

Accordingly, it is an object of the invention to develop a streamlined garment hanger that can support all types of clothing.

It is another object of the invention to develop a garment hanger that can support all types of clothing where the opposable retaining piece cannot easily be lost.

It is another object of the invention to develop a garment hanger that can support all types of clothing where the opposable retaining piece cannot easily be lost.

It is another object of the invention to develop a garment hanger upon which clothing does not get caught or snagged and does not easily accidentally fall off.

It is another object of the invention to develop a pinch clip for a garment hanger that satisfies all of the above objects.

The above and other objects are fulfilled by the invention, which is a garment hanger having a main support and a hook attached to the main support. A through-hole is formed at a first end of the main support, and a flange is formed below the through-hole. Alternatively, a gap or opening in the main support may be provided. An opposable retaining member is provided and has a proximal end and a distal end. The retaining member is spring biased closed to contact the flange, the member being openable by application of force on the proximal end. Preferably, the main support is formed in a substantially flat plane; when the proximal end is nested within the through-hole (i.e., when the retaining member is in the open position), the proximal end is substantially coplanar with the main support. Preferably, when the retaining member is open, the proximal end of the retaining member passes through the through-hole. In this way, the pivot point of the pinch clip can be made much closer to the main support of the hanger without the main support preventing the finger-grip proximal end from being fully opened. Thus, the overall thickness or profile of the hanger is greatly reduced compared to the conventional hanger. A ridge is preferably formed around the proximal end of the retaining member projecting towards the main support so as to prevent clothing from getting caught. The inventive hanger further includes a flexible attachment connecting the member to the first end of the main support. As a result, the opposable retaining member will not fall off or become separated from the main support of the hanger. Moreover, the hanger and pinch clip may be molded from a single mold, thereby reducing the costs and complexity of manufacturing.

The invention also includes a pinch clip for a garment hanger. The pinch clip includes a through-hole, gap, or opening formed at a first end of the main support, and a flange is formed below the through-hole, gap, or opening. An opposable retaining member, having a proximal end and a distal end, is provided biased closed to contact the flange. The member is openable by application of force on the proximal end thereof. Preferably, the inventive hanger is one having at least two of the inventive pinch clips, one at either end of the main support.

DETAILED DESCRIPTION OF THE PREFERRED EMBODIMENTS

Figure 1:
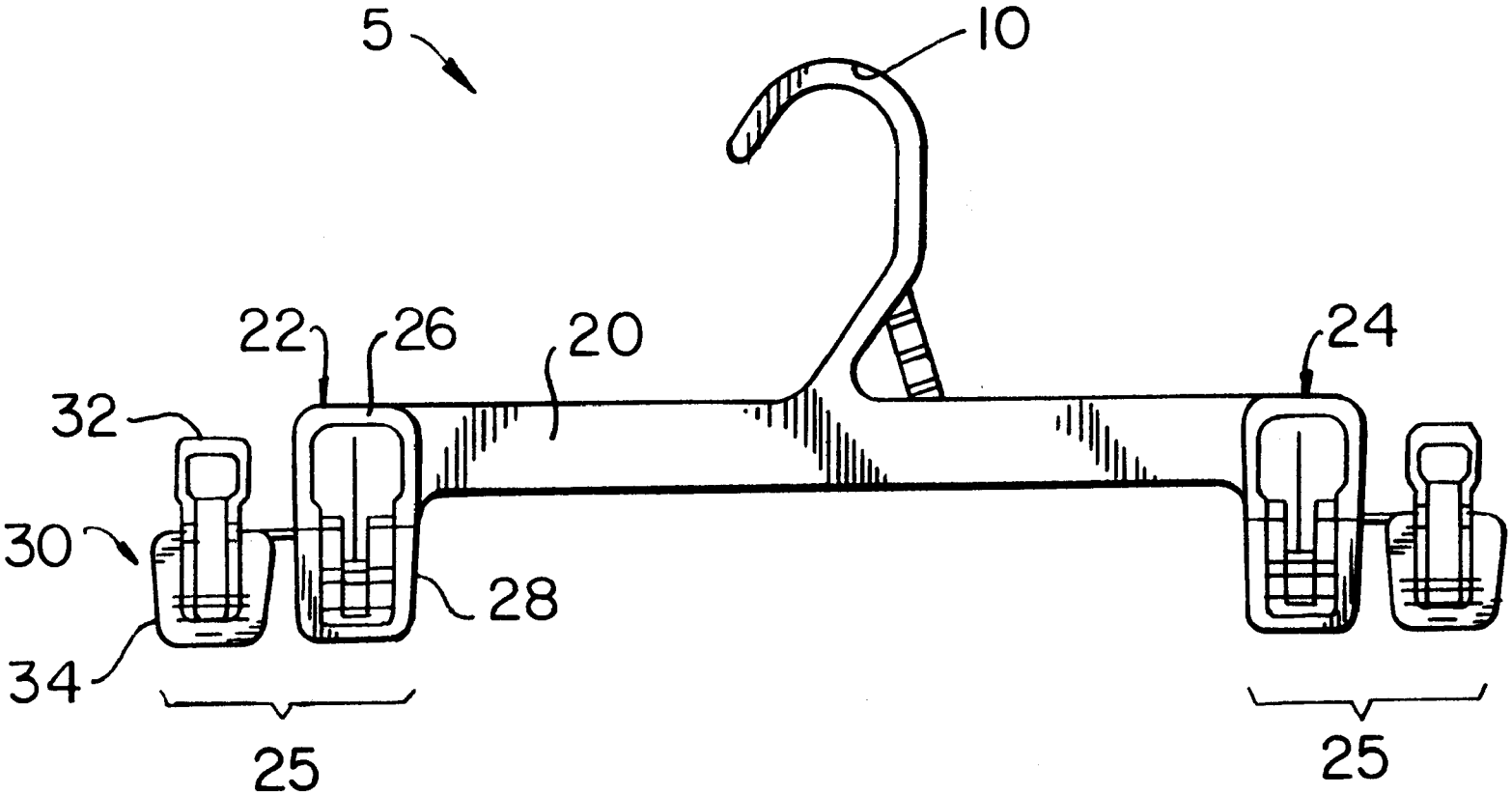
FIG. 1 is a front plan view of a garment hanger according to the present invention.
Figure 2:
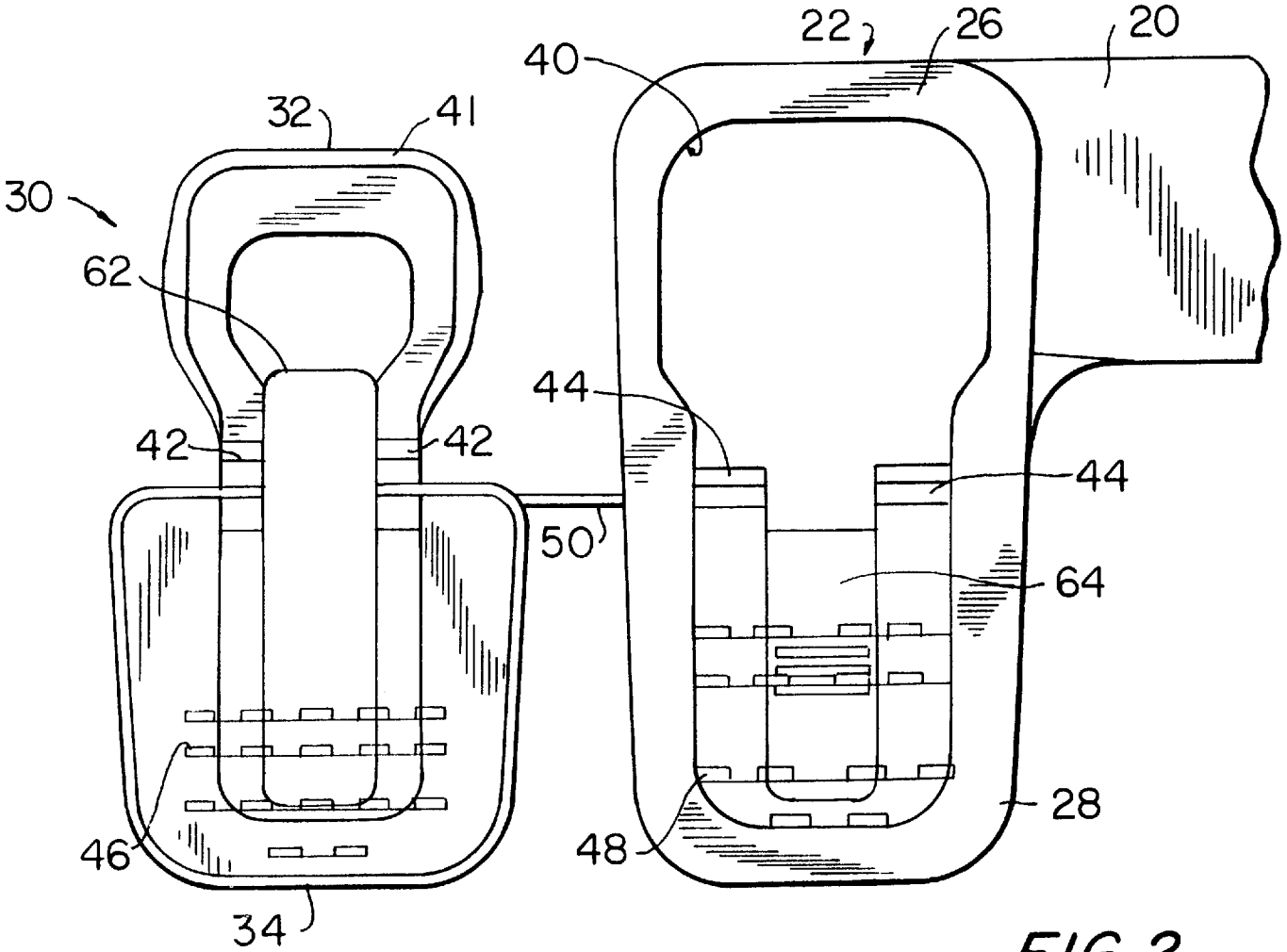
FIG. 2 is a front plan view of a pinch clip in an open configuration for a garment hanger according to the present invention.
Figure 3:
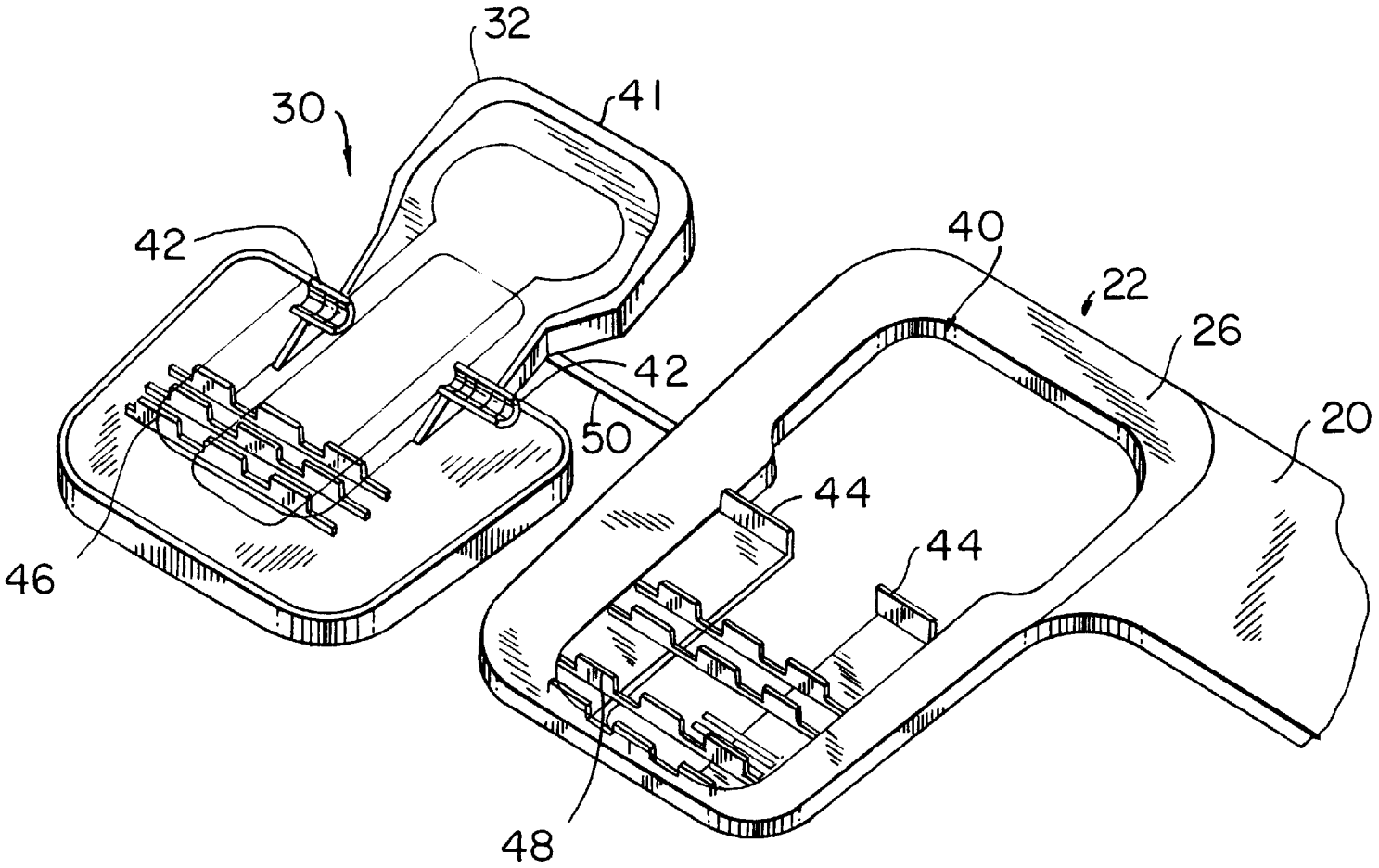
FIG. 3 is a perspective view of the pinch clip of FIG. 2.

Description will now be given to the preferred embodiment of the invention with reference to FIGS. 1–4 attached hereto. It should be realized, however, that the invention is not limited to the description provided herein but rather defined by the claims appearing hereinbelow.

The inventive hanger 5 includes a hook 10 and a main support 20. Disposed at each of the ends 22 and 24 of main support 20 are pinch clips 25. The description will focus on one pinch clip of the hanger, however the other pinch clip is intended to be substantially identical. Through-hole 40 is formed on main support 20; a recess 26 may optionally be formed around through-hole 40. Below through-hole 40 is formed a flange 28. Retaining member 30 is spring-biased against flange 28 so as to retain clothing between the distal end 34 of the retaining member and flange 28. The proximal end 32 of retaining member 30 functions as a finger-grip;

when one depresses finger-grip 32, distal end 34 rises away from flange 28, and clothing trapped therebetween in free to be removed.

Figure 4A:
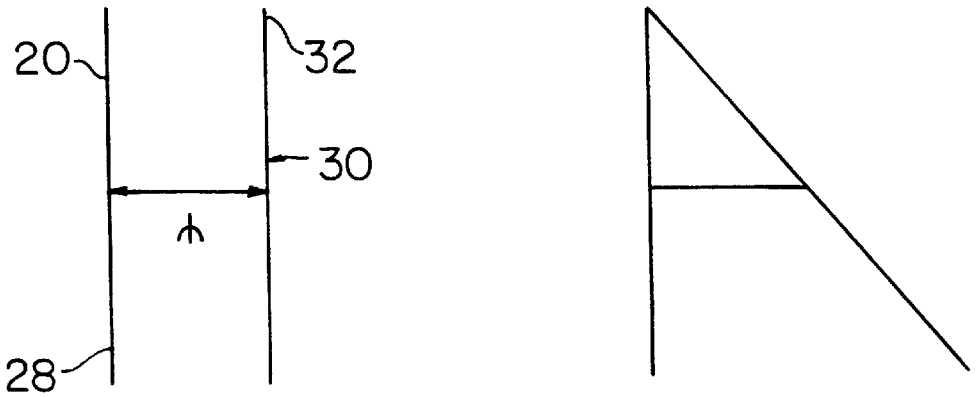
FIG. 4A is a schematic diagram of a conventional pinch clip.
Figure 4B:
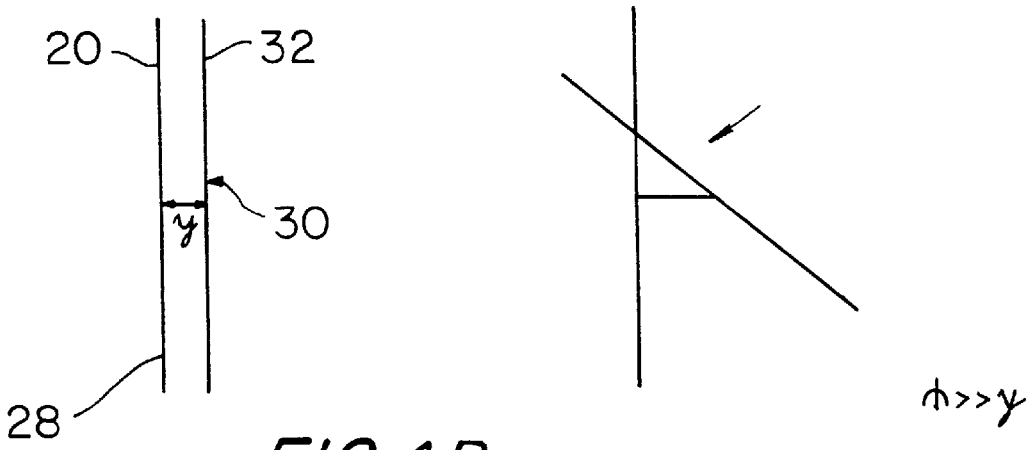
FIG. 4B is a schematic diagram of the inventive pinch clip.

As mentioned above, one of the chief problems with conventional pinch clips is that they are thick and bulky, because space must be provided between the finger-grip of the retaining piece and the main hanger support. As depicted in FIG. 4A, the conventional pinch clip must allow for a significant amount of space between the finger-grip and the main support of the hanger so that the pinch clip may be fully opened; if space is not left between the pivot point and the main support, the finger-grip will strike the main support before the distal end will fully open away from the flange. The present invention overcomes this deficiency with the provision of the through-hole 40. When one depresses finger-grip 32 of retaining member 30 to open the pinch clip 25, finger-grip 32 fits inside through-hole 40 when distal end 34 moves away from flange 28. The finger-grip proximal end 32 may pass entirely through through-hole 40 and into the plane of main support 20. When the pinch clip 25 is pressed into its open configuration, the finger-grip 32 may be substantially co-planar with main support 20. As a result, space need not be provided between finger-grip 32 and main support 20, and the entire profile of the hanger is made significantly slimmer. As depicted in FIG. 4B, it is preferable that the finger-grip 32 be adapted to pass beyond the plane of main support 20, thereby making the required pivoting distance much smaller.

Retaining member 30 has a pair of female receptacles 42 that mate with male projections 44 on flange 28. The receptacles 42 and projections 44 are provided roughly in the central portion of the pinch clip 25 and together serve as the hinge or pivot point of the clip; when one pushes finger-grip 32 down towards main support 20, distal end 34 moves up and away from flange 28.

Teeth 46 are provided on distal end 34 and matching teeth 48 are provided on flange 28. These teeth 46 and 48 help to retain clothing in the pinch clip 25 and helps to prevent the clothing from falling from the hanger. Other similar retention means that augment the frictional forces within the jaws of the pinch clips may be employed, such as ribbed rubber pieces and the like.

A rib or ridge 41 is disposed around the perimeter of finger-grip 32. The purpose of the rib 41 is to insure that clothing cannot become caught or snagged between finger-grip 32 and main support 20 or, more specifically, between finger-grip 32 and through-hole 40. Rib 41 extends downwardly from retaining member 30 towards recess 26 and through hole 40 so as to prevent lateral access to any gap between finger-grip 32 and through-hole 40. In this way, clothing cannot inadvertently be pushed into the gap and get caught or snagged improperly. Rib 41 also prevents accidental opening of the pinch clip by providing an opposing surface on the rear of finger-grip 32. That is, if something were to push the hanger up against another surface, any force exerted on finger-grip 32 would be countered by rib 41 striking/abutting that other surface through through-hole 40.

The retaining piece 30 is preferably spring-biased against the flange 28 by means of a U-shaped resilient spring clip (not shown). The spring clip fits around portion 62 of the retaining piece 30 and portion 64 of flange 28. The spring clip may be made of metal, plastic, or any resilient, elastic, shape-retaining material that has a good spring coefficient.

Retaining member 30 may be attached to the rest of the hanger by a bridge 50. Bridge 50 prevents retaining piece 30 from becoming lost should the spring clip be removed from the hanger. Bridge 50 also facilitates the molding of both the retaining piece 30 and the rest of the hanger at the same time in the same mold. For hangers designed to hold lightweight clothing, the retaining member and the main support may be molded together out of such materials as polypropylene, for example. For hangers designed to hold relatively heavy clothing, the retaining member and the main support need to be molded out of hard, less flexible plastic and may not be molded in the same molded.

Either way, the invention is not limited in any way by the type of material employed; it is contemplated that the inventive pinch clips and hangers having same may be constructed from the any material from which hangers are typically made, e.g., metal, wood, plastic, etc.

Figure 5:
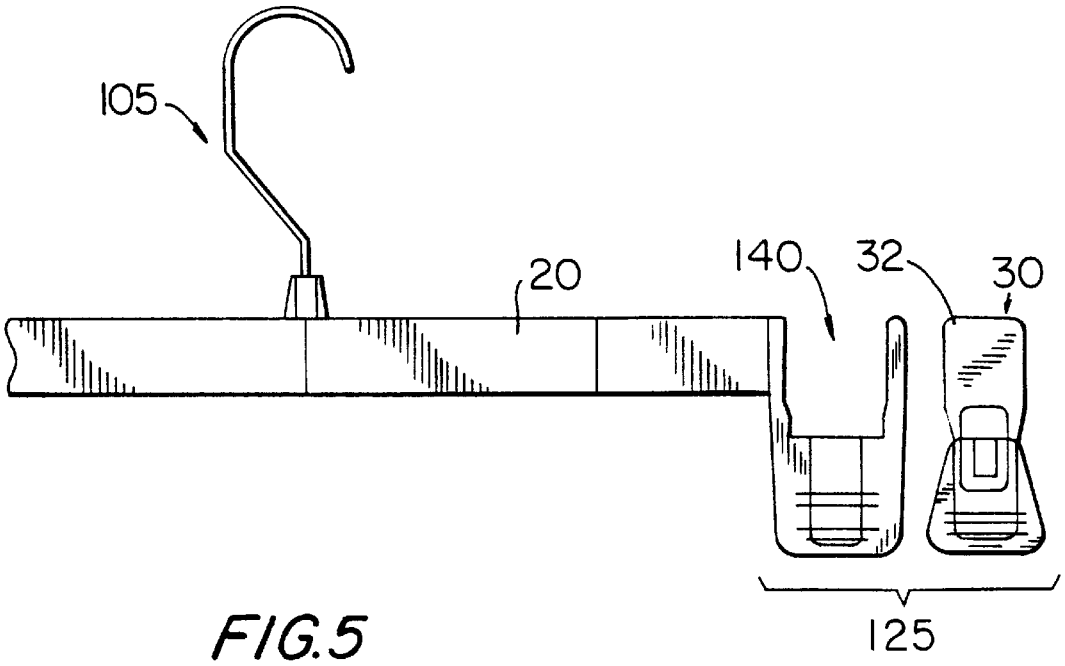
FIG. 5 is a front plan view of a first alternate embodiment of a garment hanger according to the invention.
Figure 6:
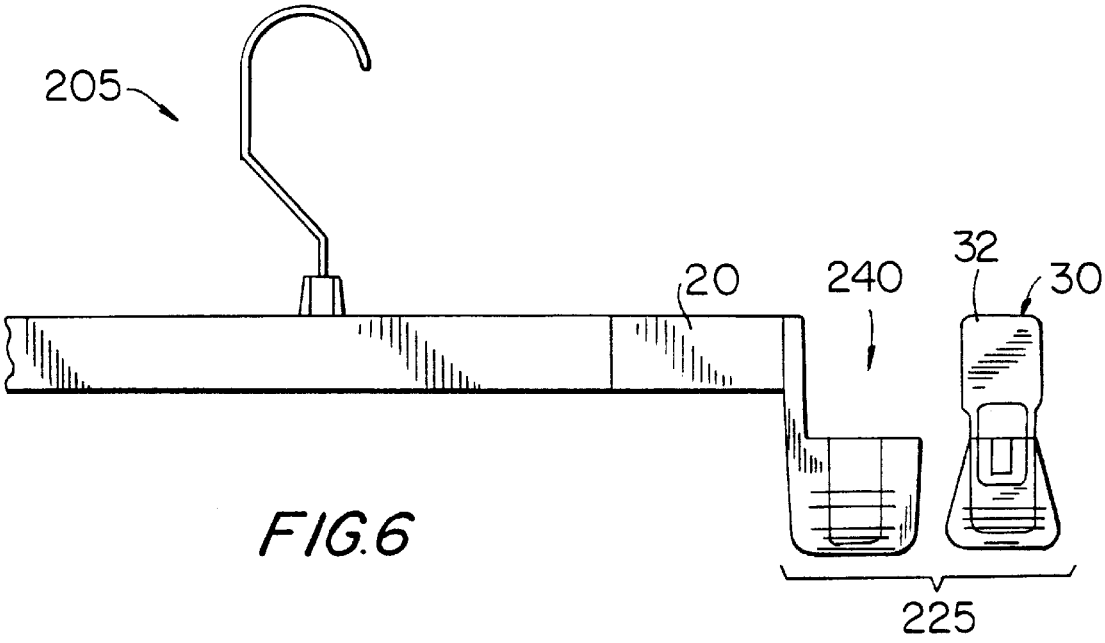
FIG. 6 is a front plan view of a first alternate embodiment of a garment hanger according to the invention.

Alternative embodiments are depicted in FIGS. 5 and 6. In FIG. 5, hanger 105 includes pinch clip 125, which is similar in structure to pinch clip 25 discussed above. However, instead of a through-hole 40 provided as a window through main support 20, pinch clip 125 includes an open gap 140 in main support 20. Open gap 140 is thus open on one side (the side closest to the top of the page in FIG. 5). Finger grip 32 passes through open gap 140 in the same way it passes through through-hole 40 in the preferred embodiment. Similarly, in FIG. 6, pinch clip 225 has open gap 240 disposed at the extreme end of main support 20 so that gap 240 is open on two sides (the top and right sides, for example, as shown in FIG. 6). Both embodiments shown in FIG. 6 employ the same concept as that shown in FIGS. 1–4, i.e., that the pivot point can be made much closer to the main support of the hanger if the finger-grip is allowed to pass through the plane of the main support.

What is claimed is:

1. A garment hanger, comprising:

a main support;

a through-hole formed at a first end of said main support;

a flange formed at said first end of said main support below said through-hole;

a hook attached to said main support; and an opposable retaining member, having a proximal end and a distal end, said retaining member biased closed to contact said distal end with said flange, said member being openable by application of force on said proximal end, wherein when said member is opened by application of force on said proximal end, said proximal end nests within and passes at least partially through said through-hole above said flange.

2. A garment hanger according to claim 1, said main support being formed in a substantially flat plane, wherein when said proximal end is nested in said through-hole, said proximal end is coplanar with said main support.

3. A garment hanger according to claim 1, further comprising a flexible attachment connecting said member to said first end of said main support.

4. A garment hanger according to claim 1, further comprising:

a second through-hole formed at a second end of said main support;

a second flange formed at said second end of said main support below said second rough-hole; and a second opposable retaining member, having a second proximal end and a second distal end, said second member biased closed to contact said distal end with said second flange, said second member being openable by application of force on said second proximal end.

5. A garment hanger according to claim 1, further comprising a raised ridge formed around said proximal end of said retaining member projecting towards said recess and said through-hole.

6. A garment hanger according to claim 5 wherein said ridge obstructs lateral access to said through-hole and substantially prevents clothing from getting caught between said proximal end and said main support.

7. A garment hanger according to claim 1, further comprising a first set of raised projections formed on said flange and a second set of raised projections formed on said distal end, said first and second sets of raised projections being engageable when said distal end contacts said flange.

8. A garment hanger according to claim 1, wherein said through-hole comprises an open gap open on at least one side.

9. A garment hanger having a pinch clip, the garment hanger having a main support and a hook attached to the main support, comprising:

a through-hole formed at a first end of said main support;

a flange formed at said first end of said main support below said through-hole; and an opposable retaining member, having a proximal end and a distal end, said member biased closed to contact said distal end with said flange, said member being openable by application of force on said proximal end, wherein when said member is opened by application of force on said proximal end, said proximal end nests within and passes at least partially through said through-hole above said flange.

10. A garment hanger having a pinch clip according to claim 9, said main support being formed in a substantially flat plane, wherein when said proximal end is nested in said through-hole, said proximal end is coplanar with said main support.

11. A garment hanger having a pinch clip according to claim 9, further comprising a flexible attachment connecting said member to said first end of said main support.

12. A garment hanger having a pinch clip according to claim 9, further comprising a raised ridge formed around said proximal end of said retaining member projecting towards said recess and said through hole.

13. A garment hanger having pinch clip according to claim 12, wherein said ridge obstructs lateral access to said through-hole and substantially prevents clothing from getting caught between said proximal end and said main support.

14. A garment hanger having pinch clip according to claim 9, further comprising a first set of raised projections formed on said flange and a second set of raised projections formed on said distal end, said first and second sets of raised projections being engageable when said distal end contacts said flange.

15. A pinch clip according to claim 9, wherein said through-hole comprises an open gap open on at least one side.

16. A garment hanger according to claim 6, wherein said ridge extends into said recess to prevent accidental opening of said retaining member.

17. A garment hanger having a pinch clip according to claim 13, wherein said ridge extends into said recess to prevent accidental opening of said retaining member.

* * * * *